United States Patent [19]

Girodin

[11] Patent Number: 4,565,118

[45] Date of Patent: Jan. 21, 1986

[54] AXIAL CYLINDER MACHINE

[75] Inventor: Georges H. Girodin, Houilles, France

[73] Assignee: S.A. Heuliez DEA, Cerizay, France

[21] Appl. No.: 597,542

[22] Filed: Apr. 6, 1984

[51] Int. Cl.[4] ..... F01B 3/00

[52] U.S. Cl. ..... 92/68; 74/60; 417/269

[58] Field of Search ..... 92/68, 71, 72, 73; 91/183, 186, 499; 417/269, 271; 74/60

[56] References Cited

U.S. PATENT DOCUMENTS

| | | | |
|---|---|---|---|
| 215,468 | 5/1879 | Legros | 92/71 |
| 501,983 | 7/1893 | Worron | 74/60 |
| 1,210,649 | 1/1917 | Holley et al. | 92/71 |
| 1,996,789 | 4/1935 | Baker | 417/271 |
| 2,539,880 | 1/1951 | Wildhaber | 74/60 |
| 4,106,354 | 8/1978 | Girodin | 91/499 |

FOREIGN PATENT DOCUMENTS

| | | |
|---|---|---|
| 694125 | 7/1940 | Fed. Rep. of Germany . |
| 1169714 | 3/1957 | France . |
| 1457610 | 9/1965 | France . |
| 2251220 | 11/1973 | France . |

*Primary Examiner*—Paul E. Maslousky

*Attorney, Agent, or Firm*—Leydig, Voit & Mayer, Ltd.

[57] ABSTRACT

An axial cylinder machine includes a shaft, journaled in one end of a housing to turn about its axis and a plurality of cylinders. A spider is mounted inside the housing by means of a main swivel connection to swivel about a center which is disposed along the shaft axis and the spider includes a plurality of arms, one for each cylinder, projecting generally radially from the center with one projecting in under each cylinder. Each cylinder includes a rod, one end of which swivels on the piston sliding in the cylinder and the other end of which is connected by a swivel connection to the outer end of the associated arm of the spider. As a result, the spider swivels with a generally circular motion about its center when the pistons are successively reciprocated or vice versa. The main swivel connection comprises a stationary shallow cone facing upwardly and engaged by a downwardly facing shallow cone carried by the spider. The axes of the cylinders are inclined to lie on the surface of an imaginary cone which has its apex adjacent the shaft and its base adjacent the cylinders.

7 Claims, 1 Drawing Figure

AXIAL CYLINDER MACHINE

BACKGROUND OF THE INVENTION

This invention relates to an axial cylinder machine in which a shaft is journaled in one end of a housing and a plurality of cylinders are mounted on the other end of the housing and are equally spaced around the axis of the shaft. A spider is mounted in the housing to swivel about a main swivel connection centered along the axis of the shaft. Arms project generally radially from the spider and the outer end of each arm is connected by a swivel connection to a rod the other end of which is connected by a swivel to the piston in a cylinder. A head offset from the shaft axis is journaled in a crank connected to the shaft whereby successive reciprocation of the pistons swivels the spider in a generally circular manner to cause the head to revolve about the axis of the shaft and to turn the latter through the crank. Conversely, the shaft may be turned to swivel the spider and reciprocate the pistons.

SUMMARY OF THE INVENTION

The general object of the invention is to provide a new and improved machine of the foregoing type which, as compared to prior machines, more effectively transmits reciprocating forces at the pistons and translates the reciprocating and rotary forces.

Another object is to construct the machine so that the cylinders may easily be cooled with air without destroying the compactness and the light weight of the machine.

A more detailed object is to achieve the foregoing by making the main swivel connection with a stationary swivel surface which faces away from the shaft and which is engaged by a coacting swivel surface carried by the spider.

A further object is to arrange and incline the cylinders so that their axes lie on the surface of an imaginary cone the apex of which is adjacent the shaft and the base of which is adjacent the cylinders.

The invention also resides in the particular construction and arrangement of the swivel joint, of the spider and of the crank in association with the spider head and the shaft.

DETAILED DESCRIPTION OF THE PREFERRED EMBODIMENTS

Figure 1:
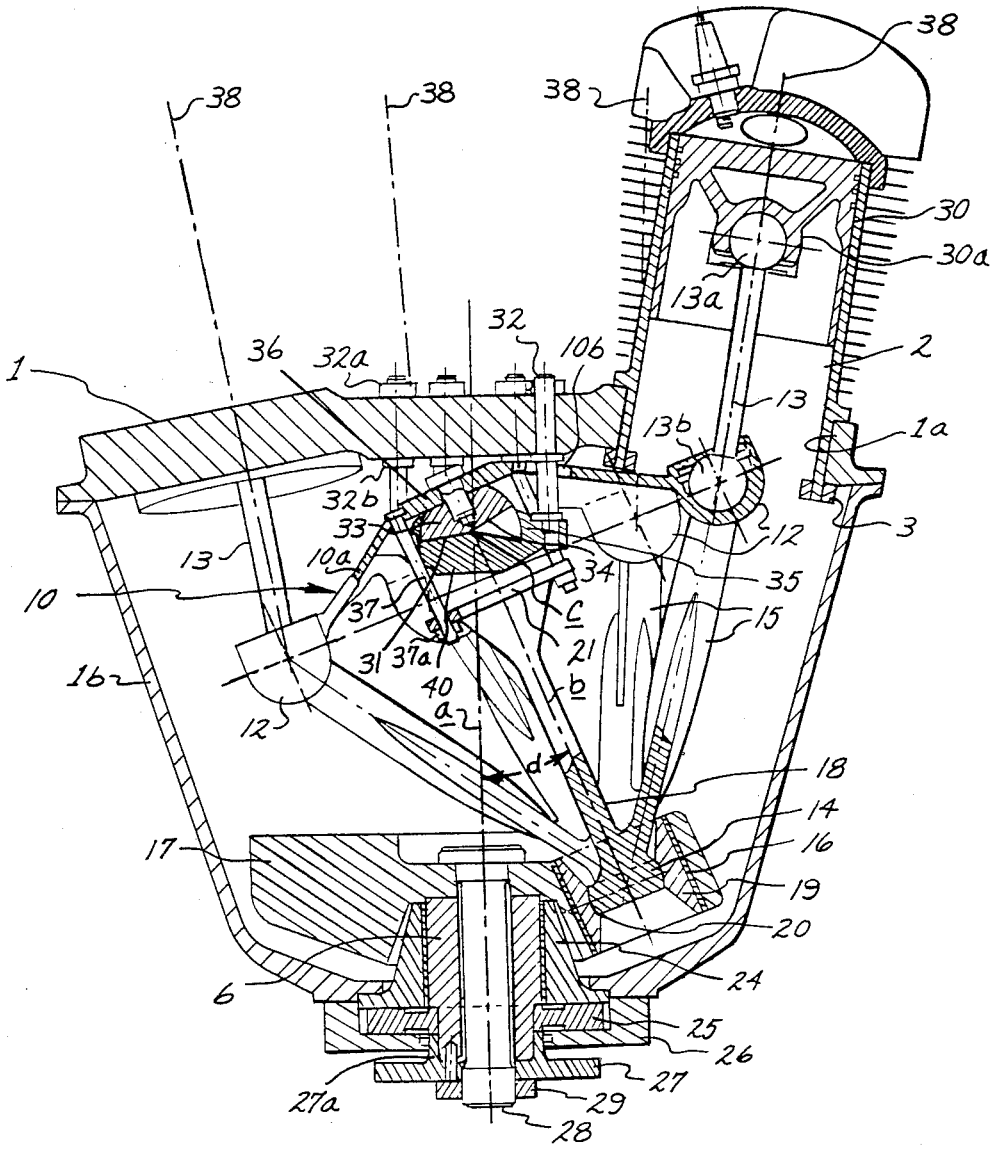
FIG. 1 is a longitudinal sectional view of an axial cylinder machine embodying the invention of the present application.

Although the invention is applicable to various types of axial-cylinder machines such as motors, compressors and pumps, it is shown in the drawings for purposes of illustration as embodied in an internal combustion engine having a plurality of cylinders 2 with pistons 30 which drive an output shaft 6. Herein, there are seven cylinders, only one of which is shown in detail, which are disposed with their axes 38 equally spaced angularly around the axis a of the output shaft. In general, the pistons 30 of the cylinders operate through their rods 13 to wobble or swivel a spider member 10 with a generally circular motion about a center c which lies on the axis a. As a result, a rotatable head 14 carried by the spider and journaled in a crank member 17 revolves about the axis a and turns the crank member about this axis. The crank member is secured to the output shaft so that the latter also turns about the axis.

Herein, the cylinders 2 are mounted in bores 1*a* in a top plate 1 of a housing 1*b* and each is held in place by a nut 3 which is threaded onto the lower end portion of the cylinder and which draws a radial flange 2*a* on the cylinder down against the top of the plate. The upper end of each of the rods 13 carries a ball 13*a* which is received in a socket 30*a* in the piston 30 to provide a swivel connection between the rod and the piston and the lower end of the rod similarly is coupled to the spider 10 by a swivel connection composed of a ball 13*b* which is on the lower end of the rod and is received in a socket 12 on the spider adjacent the periphery of the latter. As will be described more in detail later, the spider is supported to swivel on the plate 1 by a main swivel connection 31, 34 and a center post 18, which is rigid with the spider, extends downwardly along the centerline b of the latter to support the head 14.

The present invention contemplates the provision of a new and improved machine of the foregoing type which, as compared to prior machines, more effectively transmits the reciprocating forces at the pistons 30 and translates the reciprocating forces into rotary forces which turn the output shaft 6. In addition, cooling of the cylinders 2 with air is facilitated without destroying the compactness and the light weight of the machine. To achieve the foregoing, the swivel connection 31, 34 includes a stationary swivel surface which is disposed along the axis a of the output shaft 6 and which faces axially away from the shaft to be engaged by a coacting surface carried by the spider 10. In another aspect of the invention, the cylinders 2 are inclined so that their axes 38 lie on the surface of an imaginary cone the apex of which is on the axis a adjacent the shaft 6, that is, the cone is inverted relative to the cylinders and its base is adjacent the cylinders.

In the form illustrated in FIG. 1, the stationary swivel surface is in the shape of an upward facing shallow cone 31 formed in a stationary part 40 which is rigidly supported by the housing plate 1 by means of a plurality of posts 32. Herein, there are seven such posts, one associated with each of the cylinders 2 and each disposed in a plane defined by the axis 38 of the associated cylinder and the axis a of the output shaft 6. Each post projects up through a bore in the plate 1 and is rigidly secured to the latter by a nut 32*a* which is threaded onto the upper end of the post and draws a flange 32*b* on the post against the underside of the plate. The lower ends of the posts are threaded into or otherwise suitable secured to the part 40.

The spider 10 is in the form of a truncated cone with the top facing generally away from the output shaft 6 and constituted by a plate 36. The side of the cone is defined by seven arms 10*a* projecting radially and downwardly from the plate and being equally spaced angularly around the centerline b. Each arm projects in under one of the cylinders 2 and the sockets 12 which receive the balls 13*b* are formed on the ends of the arms and, by virtue of the arms being inclined, the plane of the centers and the sockets is perpendicular to the centerline b and is offset from the center c toward the head 14. The posts 32 project through longitudinal slots 10*b* in the arms to permit the spider to tilt in response to the action of the cylinders 30.

The swivel connection for the spider 10 utilizes opposing cones which, within the concept of the invention, may be truncated cones. Thus, part 40 is fixed to the top plate 1 by posts 32 and an upwardly facing surface 31 on the plate is in the shape of a shallow cone having its apex at c on the axis which also is the axis of the cone. A part 33 has a downwardly facing surface 34 shaped as a shallow cone which opposes the surface 31, the part 33 being pinned to the top plate 36 of the spider 10. The center line b is the axis of the conical surface 34 and the apexes of the two conical surfaces are coincidental at the center c, about which the spider swivels. Bolts 37 mount the plate 36 on the plate 21 which is on the upper end of the center post 18.

To transmit the forces of the pistons to the head 14, rods 15 formed integrally with the sockets 12 project downwardly and inwardly from the latter and the lower ends merge and are integral with the lower end of the post 18. The spider is held down on the part 4 while being permitted to turn about the center c by bolts 37 which project through the plate 36 and through a plate 21 on the top of the post 18 and nuts 37*a* are threaded onto the lower ends of these bolts. The swivel connection maintains the center c in a fixed position relative to the axes 38 of the cylinders 2 and to the axis a of the output shaft 6.

To transmit the motion of the spider 10 to the crank 17 while permitting some play between the parts, the head 14 is formed with an annular surface 20 which is concentric with the centerline b and which is convex and spherical in shape and this surface is received in a complementally concave shaped surface on the inside of a cylindrical journal member 19. The latter is free to turn in a cylindrical bearing 16 pressed into a bore in the crank 17 with the bearing, the journal member and the head being substantially centered on the centerline b. The crank 17 is seated on top of the output shaft 6 which is journaled in the internal bearing surface of a collar 24 fixed to the housing 1*b*. Keyed to the shaft beneath the collar is a double-acting lug piece 25 which is disposed between the collar and a stationary disc 26 fixed to the bottom of the housing 1*a*. The upper and lower sides of the lug piece slide respectively on the opposing axial bearing surfaces of the collar and the disc to maintain the longitudinal position of the output shaft 6 and the angular position of the latter along the axis a. An output plate 27 is pinned to the bottom of the shaft 6 to rotate with the latter and an axial hub 27*a* on the plate projects into and is journaled in the disc 26. A bolt 28 projects axially through the crank, the output shaft and the plate to cooperate with a nut 29 in holding these parts together. For increased stability and effectiveness in transmitting the forces, the parts are located so that the transverse plane through the center of the head 14 intersects the axis a of the shaft 6 between the ends of the bearing surface in the collar 24.

Although the part 40 may have an external spherical surface and coact with a complemental seat on the plate 21 and it is preferred to use the part 33 for the counter swivel joint. Thus, the upper surface of the part 33 is spherical and swivels in a flange 35 which projects upwardly from the part 40 around the conical surface 31 and which has an internal spherical surface mating with the spherical surface on the part 33. The conical surfaces 31 and 34 engage each other with a line contact along a radius from the center c and this contact revolves around the center upon the successive strokes of the pistons to produce the desired motion of the spider 10. The relationship of the cones 31 and 34 and the position of the head 14 on the crank member 17 may be expressed as: The apex angle of the cone 31 plus the apex angle of the cone 34 plus twice the angle d between the axis a and the centerline b equals 360 degrees.

I claim:

1. An axial cylinder machine having, in combination, a housing, a shaft journaled in one end of said housing to turn about an axis extending longitudinally of the housing, a plurality of cylinders mounted on the other end of said housing and equally spaced angularly about said axis, a plurality of pistons, one for each of said cylinders and each sliding in the associated cylinder, a plurality of rods, one connected to each of said pistons and each projecting into said housing, a spider member disposed in said housing and having a centerline inclined to said axis and intersecting the axis at a center point, a plurality of swivel connections, one for each of said rods and each connecting the associated rod to said member, said swivel connections being radially spaced from said centerline and equally spaced angularly around the centerline, a main swivel connection supporting said member in said housing to swivel about said center point, a crank fast on said shaft and projecting radially outwardly from the axis, a post rigid with said member and extending along said centerline toward said crank, and a bearing rotatably supporting an end portion of said post in said crank whereby said end portion revolves about said axis as said member swivels about said center point and as said pistons reciprocate in said cylinders, said main swivel connection comprising a first part rigidly mounted on said housing and having a first swivel surface facing axially away from said shaft, said first swivel surface being a conical surface having its apex at said center point and its axis being coincident with the axis of said shaft, and a second part rigid with said member having a second swivel surface, said second swivel surface being a conical surface having its apex at said center point and its axis being coincident with said centerline, said conical surfaces engaging each other along radially extending lines such that said second swivel surface opposes said first swivel surface and engages the latter to swivel on the first swivel surface as said end portion of said post revolves about said axis.

2. A machine as defined in claim 1 in which said first swivel surface is a shallow cone and said second swivel surface is a shallow cone.

3. A machine as defined in claim 2 in which the first swivel surface is convex in shape, and the centers of said first and second swivel surfaces are coincident at said center point.

4. A machine as defined in claim 1 including a counter swivel connection comprising an external convex spherical surface on said second part and a mating concave spherical surface rigid with the first part, with both of said surfaces having their centers at said center point, said counter swivel connection being operable to hold the conical surfaces of said main swivel connection in engagement.

5. A machine as defined in claim 1 in which the conical surfaces are truncated cones.

6. A machine as defined in claim 1 in which the axes of said cylinders are inclined relative to the axis of said shaft to lie on the surface of an imaginary cone having its apex on the axis of the shaft adjacent the latter with the base of the cone adjacent the cylinders.

7. A machine as defined in claim 1 in which the bearing is cylindrical and coaxial with said centerline, said bearing comprising a sleeve having a generally annular concave spherical surface coaxial with said centerline and a generally convex spherical surface formed on said end portion of said post and mating with said concave surface to permit the post to swivel slightly relative to said crank.

* * * * *